US008083368B2

(12) United States Patent
Lau

(10) Patent No.: US 8,083,368 B2
(45) Date of Patent: Dec. 27, 2011

(54) SPOT LIGHT

(76) Inventor: Fermi Chi Hung Lau, Kowloon (HK)

( * ) Notice: Subject to any disclaimer, the term of this patent is extended or adjusted under 35 U.S.C. 154(b) by 96 days.

(21) Appl. No.: 12/387,699

(22) Filed: May 5, 2009

(65) Prior Publication Data

US 2010/0284175 A1 Nov. 11, 2010

(51) Int. Cl.
*F21L 4/00* (2006.01)
*F21V 21/08* (2006.01)
*F21S 8/00* (2006.01)

(52) U.S. Cl. ..... 362/157; 362/208; 362/399; 362/427

(58) Field of Classification Search ..... 362/157, 362/190, 191, 209, 399, 410, 413, 208, 427
See application file for complete search history.

(56) References Cited

U.S. PATENT DOCUMENTS

| | | | | |
|---|---|---|---|---|
| 1,367,369 | A * | 2/1921 | Friend | 248/688 |
| 2,706,610 | A * | 4/1955 | Roberts | 248/168 |
| 3,471,849 | A * | 10/1969 | Cheng | 340/321 |
| 3,604,914 | A * | 9/1971 | Gibson | 362/191 |
| 3,936,022 | A * | 2/1976 | Nicholl | 248/137 |
| 4,403,678 | A * | 9/1983 | Zieg | 182/153 |
| 4,536,032 | A * | 8/1985 | Highberger | 297/423.41 |
| 5,816,684 | A * | 10/1998 | Yu | 362/191 |
| 6,056,414 | A * | 5/2000 | Krieger | 362/184 |
| 6,099,142 | A * | 8/2000 | Liu | 362/191 |
| 6,158,876 | A * | 12/2000 | Birdwell | 362/208 |
| 6,669,353 | B2 * | 12/2003 | Kung | 362/191 |
| 7,393,117 | B2 * | 7/2008 | Dalton et al. | 362/157 |
| 2005/0007769 | A1 * | 1/2005 | Bonzer et al. | 362/157 |
| 2006/0176688 | A1 * | 8/2006 | Yuen | 362/184 |

FOREIGN PATENT DOCUMENTS

WO WO 9428347 A1 * 12/1994

* cited by examiner

*Primary Examiner* — David Crowe
(74) *Attorney, Agent, or Firm* — Raymond Y. Chan; David and Raymond Patent Firm

(57) ABSTRACT

A spot light includes a universal body, a light arrangement, and a spot light accessory. A spot light accessory having a plurality of accessory elements selectively and detachably coupling with the universal body to transform the universal body from one configuration to another configuration such that the type of spot light, the hand carry method, and even the supporting method of the floor stand are flexible depends on the customers needs.

13 Claims, 6 Drawing Sheets

SPOT LIGHT

BACKGROUND OF THE PRESENT INVENTION

1. Field of Invention

The present invention relates to a spot light, and more particular to a spot light comprises a spot light accessory having a plurality of accessory elements selectively and detachably coupling with the universal body to transform the universal body from one configuration to another configuration while being cost effective.

2. Description of Related Arts

A flash light is a common tool in our daily life to provide light in the dark or additional light in specific situation. Nowadays, it not only uses for people to see clearer, but also becomes a type of decoration. Except for the brightness of the flash light, the consumer puts more emphasis on their function whether or not the flash lights are convenient for the consumer to use.

A conventional flash light is usually a portable electric spotlight which emits light from a light bowl. Because people prefer greater choice of flash light, they are more and more different kinds of flash lights sold on the market. People usually can choose different appearances and functions to match their preference. Therefore, the user does not need to worry about that they cannot find the right flash light they like. However, most of the flash lights sold on the market are only focus on the some specific usages; for example, when people want to find a flash light having a very intensive light, the volume and weight of the flash light are usually big. Also, it is troublesome for a people to place the flash light on the ground. On the other hand, when people try to find a flash light having a very flexible structure easy for people to assemble and disassemble, the intensity of the light are usually smaller. Moreover, the flash light may made of some light material such that it is not durable enough for a long period of use.

Furthermore, no matter which type of the flash light is used, there exist some problems on how to support the flash light on the ground while there is no stand or support on the ground or no one can help. In general, the flash light is usually support by some people or standing on the stand. In order words, like camera, the flash light requires a stand to support on its bottom to secure its position. On the other hand, if the volume and weight of the flash light is large, some specific appliance is needed to assist people to hand carry or moving.

It is necessary to develop a flash light to solve the problem as mentioned before to keep the flash light convenient and easier to use.

SUMMARY OF THE PRESENT INVENTION

A main object of the present invention is to provide a spot light, wherein the spot light comprises a spot light accessory having a plurality of accessory elements selectively and detachably coupling with the universal body to transform the universal body from one configuration to another configuration so as to provide varieties of functional utilizations of the universal body. In other words, the type of spot light, the hand carry method, and even the supporting method of the floor stand are flexible depends on the customers needs. Moreover, the commercial value of the spot light dramatically increases owing to providing varieties of functional utilizations for different needs.

Another object of the present invention is to provide a spot light, wherein the spot light comprises a U-shaped handle member coupling at a top side of the main body such that the universal body with the handle member form a handheld spot light for allowing a user to carry the spot light.

Another object of the present invention is to provide a spot light, wherein the front leg frame and the rear leg frame are pivotally coupling at front and rear portions of the main body at a bottom side thereof respectively, such that the universal body with the front and rear leg frames forms a floor stand spot light.

Another object of the present invention is to provide a spot light, wherein the illumination unit within the light body is replaceable such that the user is able to choose the type of the illumination unit they preferred to meet different need in different situation.

Another object of the present invention is to provide a spot light, wherein the structure of the spot light is simple therefore making the apparatus easy to assemble and disassemble.

Accordingly, to achieve above mentioned objects, the present invention provide a spot light, comprising: a universal body, a light arrangement, and a spot light accessory.

The universal body comprises a main body having a receiving compartment, and a light body, having a light cavity and a light opening, frontwardly and integrally extending from the main body.

The light arrangement is supported within the universal body for generating light towards the light opening.

The spot light accessory comprises a plurality of accessory elements selectively and detachably coupling with the universal body to transform the universal body from one configuration to another configuration so as to provide varieties of functional utilizations of the universal body.

The spot light comprises a U-shaped handle member coupling at a top side of the main body such that the universal body with the handle member form a handheld spot light for allowing a user to carry the spot light.

The front leg frame and the rear leg frame are pivotally coupling at front and rear portions of the main body at a bottom side thereof respectively.

These and other objectives, features, and advantages of the present invention will become apparent from the following detailed description, the accompanying drawings, and the appended claims.

DETAILED DESCRIPTION OF THE PREFERRED EMBODIMENT

Figure 1:
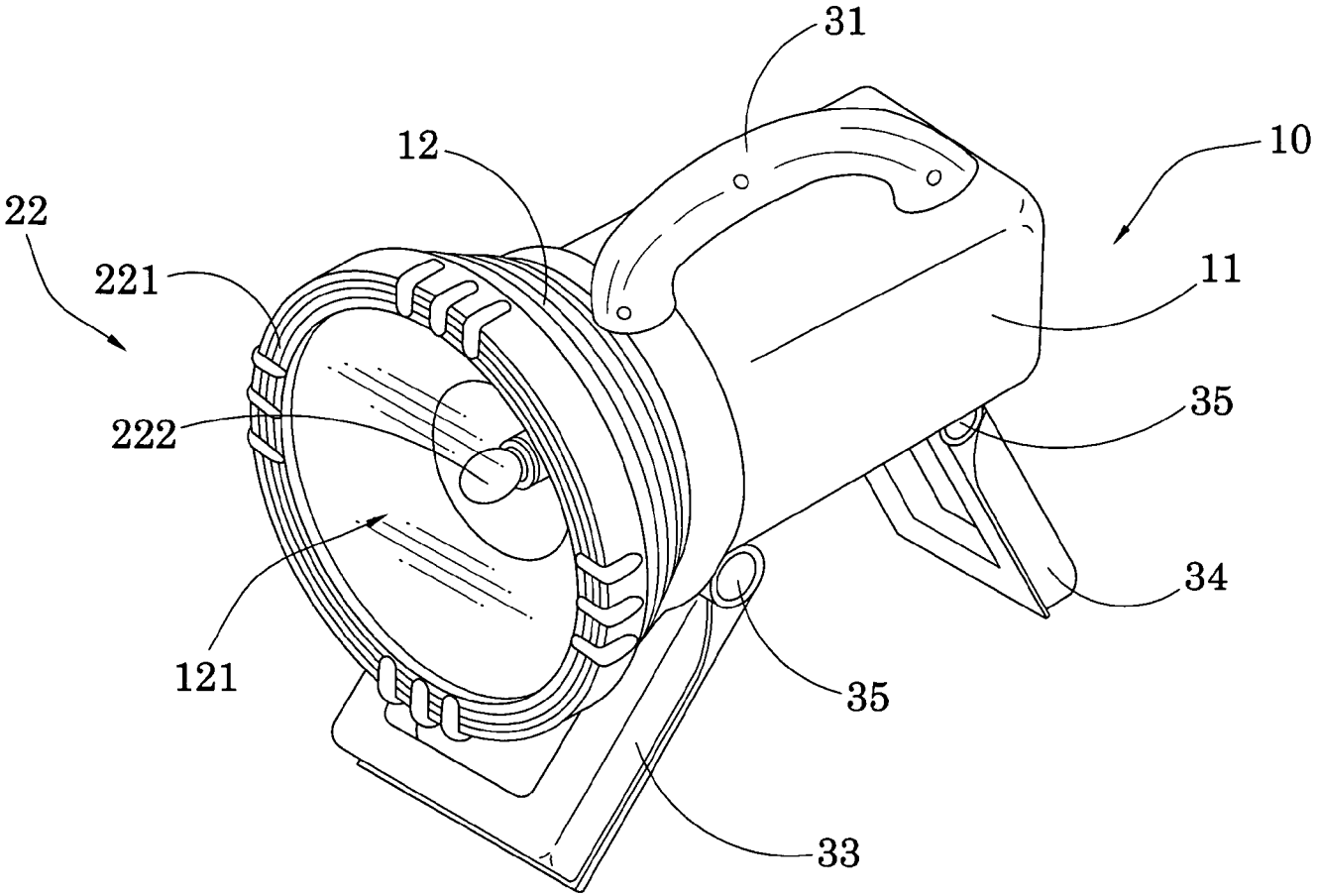
FIG. 1 is a perspective view of a spot light according to a preferred embodiment of the present invention.
Figure 2:
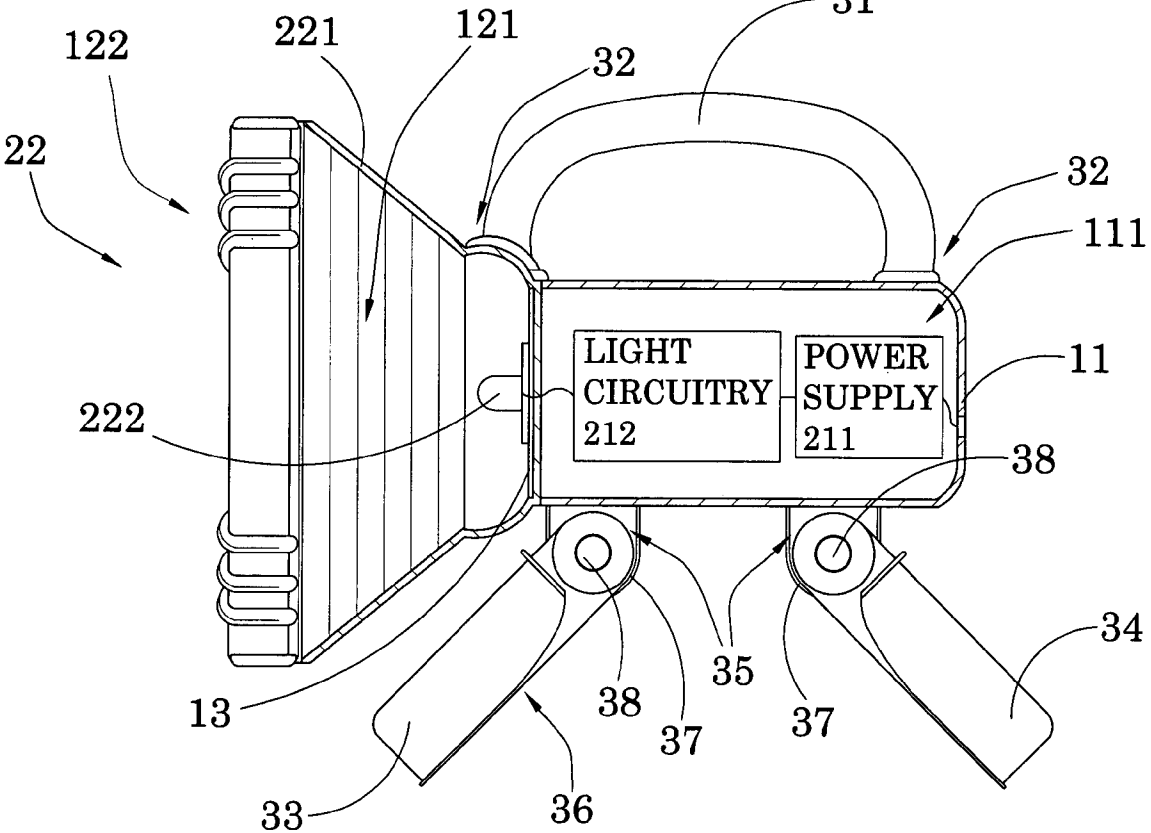
FIG. 2 is a sectional view of the spot light according to the above preferred embodiment of the present invention.

Referring to FIGS. 1 and 2 of the drawings, a spot light according to a preferred embodiment of the present invention is illustrated, in which a spot light comprises a universal body 10, a light arrangement 20, and a spot light accessory 30.

The universal body 10 comprises a main body 11 having a receiving compartment 111, and a light body 12, having a light cavity 121 and a light opening 122, frontwardly and integrally extending from the main body 11. The universal body 10 is made of non-fragile materials such as plastic materials and is made by injection or other conventional manufacturing process to integrally form the main body 11 with the light body 12 in one piece integrated structure. The light arrangement 20 supports by the universal body 10 for generating light towards the light opening 122.

The spot light accessory 30 comprises a plurality of accessory elements selectively and detachably coupling with the universal body 10 to transform the universal body 10 from one configuration to another configuration so as to provide varieties of functional utilizations of the universal body 10. In other words, the type of spot light, the hand carry method, and even the supporting method of the floor stand are flexible depends on the customers needs. Moreover, the commercial value of the spot light dramatically increases owing to providing varieties of functional utilizations for different needs.

Figure 3:
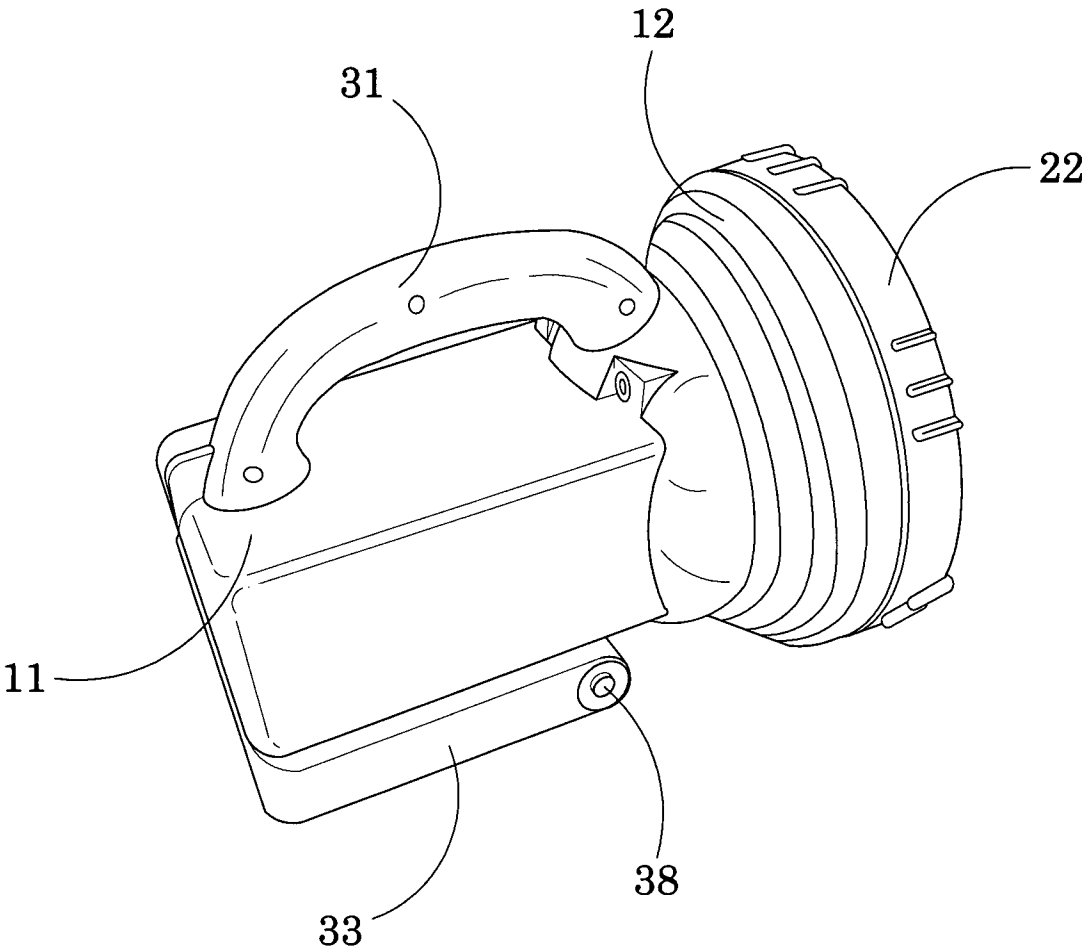
FIG. 3 is an upper view of the spot light illustrating the structure of the handle member.

Referring to FIG. 3 of the drawing, the spot light accessory 30 comprises a U-shaped handle member 31 as one of the accessory elements coupling at a top side of the main body 11 such that the universal body 10 with the handle member 31 forms a handheld spot light for allowing a user to carry the spot light. Therefore, compared with holding in the middle of the universal body, the handle member 31 provides a much easier way for people to hold and move the spot light. Moreover, the spot light accessory 30 has two spaced apart attachment slots 32 integrally pre-formed at the top side of the main body 11 to couple with two ends of the handle member 31 respectively such that the type of the handle member is replaceable to fulfill the users' need.

Figure 4A:
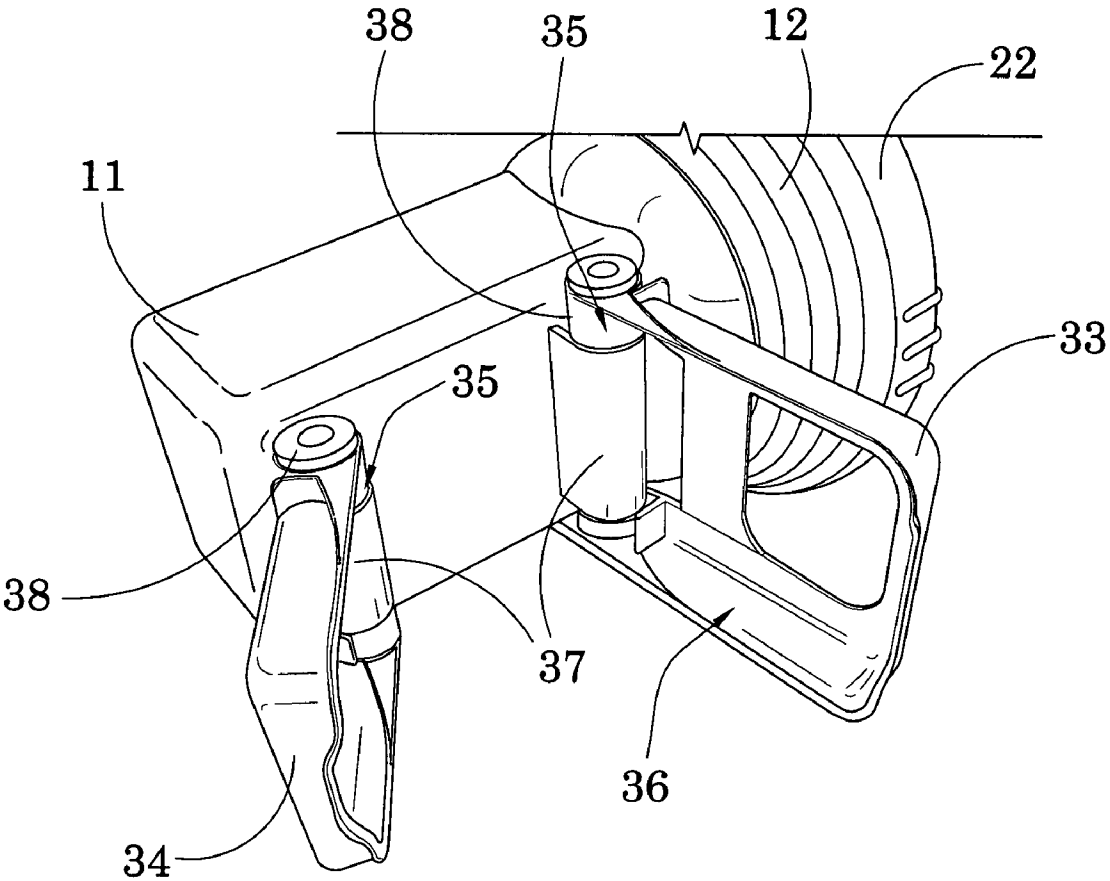
FIGS. 4A to 4B are bottom view of the spot light illustrating the steps from open to close the floor stand.
Figure 4B:
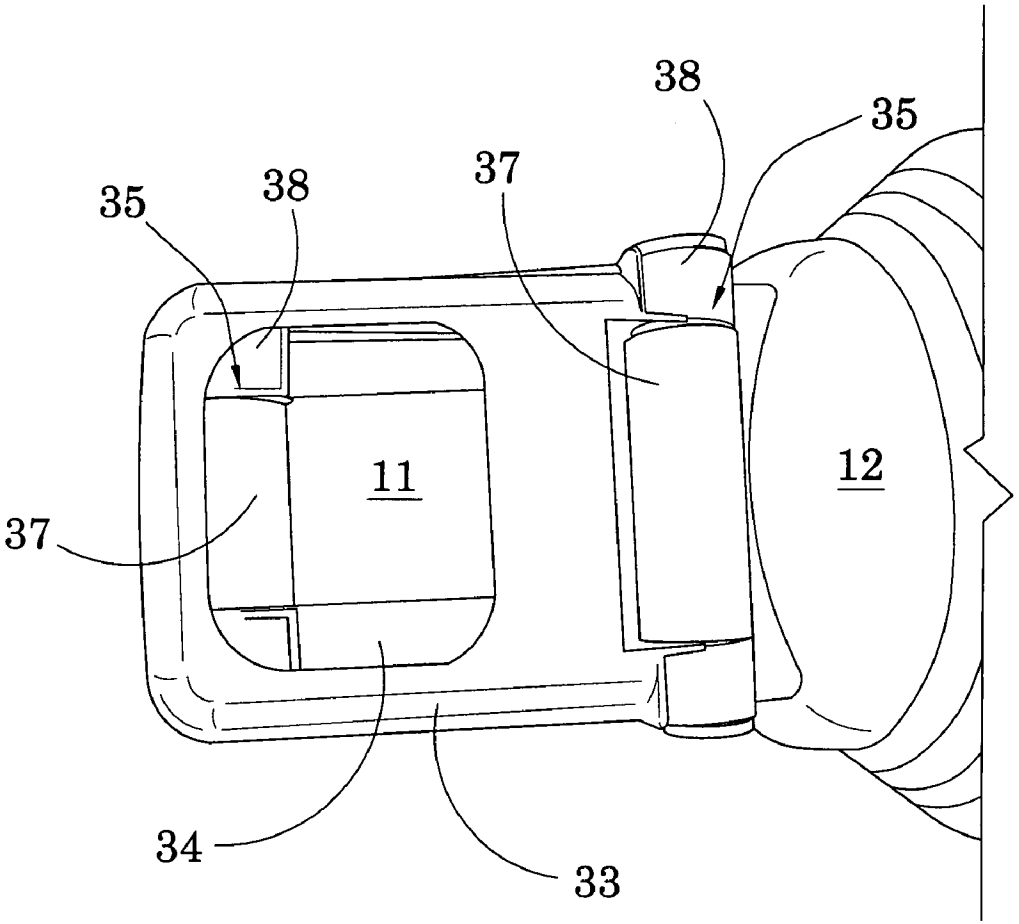
Figure 5:
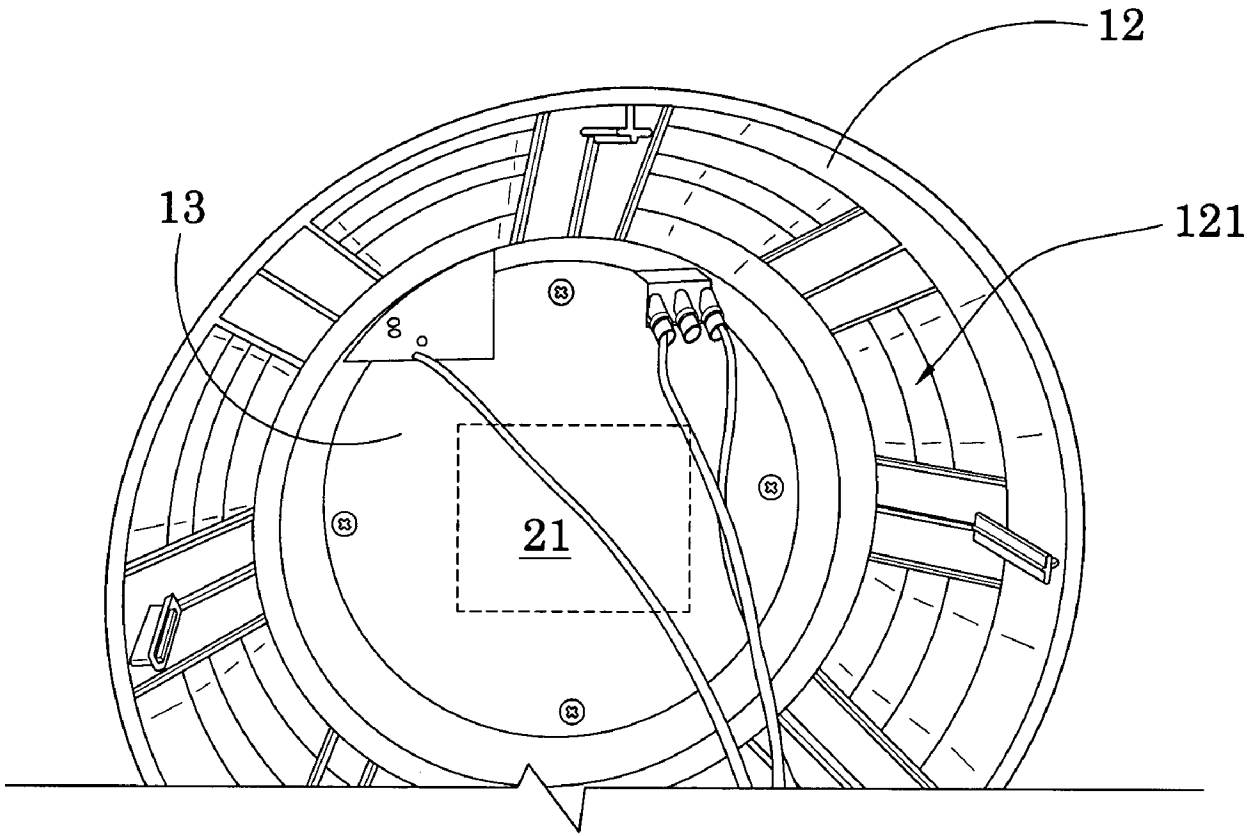
FIG. 5 is a front view of the spot light illustrating the structure of the light body.

As shown in FIGS. 4A and 4B, the spot light accessory 30 comprises a U-shaped front leg frame 33 and a U-shaped rear leg frame 34 as the accessory elements, wherein the front leg frame 33 and the rear leg frame 34 are pivotally coupling at front and rear portions of the main body 11 at a bottom side thereof respectively, such that the universal body 10 with the front and rear leg frames 33, 34 form a floor stand spot light.

The spot light accessory 30 has two spaced apart pivot slots 35 integrally and longitudinally pre-formed at the bottom side of the main body 11 to pivotally couple with the front and rear leg frames 33, 34 respectively. Accordingly, the spot light accessory 30 comprises two tubular members 37 spacedly and longitudinally provided at the bottom side of the main body 11 at front and rear portions thereof respectively, wherein the pivot slots 35 are defined within the tubular members 37 respectively. The spot light accessory 30 further comprises two axis lockers 38 for detachably locking the front and rear leg frames 33, 34 at the tubular members 37 in a pivotally movable manner. Accordingly, the axis lockers 38 are slidably and rotatably disposed within the pivot slots 35 respectively, wherein the front and rear leg frames 33, 34 are pivotally locked at the axis lockers 38 at the ends thereof such that the front and rear leg frames 33, 34 are adapted to pivotally fold between a folded position and an unfolded position.

FIGS. 4A and 4B show steps from open to close the floor stand. The front leg frame 33 has a receiving cavity 36 having a size larger than a size of the rear leg frame 34, wherein the front and rear leg frames 33, 34 are adapted to pivotally fold at the folded position at a position that when the rear leg frame 34 is pivotally and frontwardly folded on the bottom side of the main body 11, the front leg frame 33 is pivotally and rearwardly folded to enclose the rear leg frame 34 within the receiving cavity 36.

It is worth to mention that the axis lockers 38 are adapted to limit the pivotally folding angles of the front and rear leg frames 33, 34 at the unfolded position for preventing the further pivotal movements of the front and rear leg frames 33, 34. In addition, the folding angle of each of the front and rear leg frames 33, 34 should be larger than 90° when each of the front and rear leg frames 33, 34 is pivotally folded from the bottom side of the main body 11 at the folded position to the unfolded position. Therefore, the front and rear leg frames 33, 34 are inclinedly and outwardly extended from the bottom side of the main body 11 to stably support the universal body 10 on the ground.

Moreover, the light arrangement 20 comprises an electrical unit 21 supported within the receiving compartment 111 of the main body 11 and an illumination unit 22 replaceably supported at the light cavity 121 of the light body 12 to electrically couple with the electrical unit 22. In other words, the illumination unit 22 within the light body 12 is replaceable such that the manufacturer or the user is able to choose the type of the illumination unit 22 he or she preferred to meet different need in different situation.

The illumination unit 22 comprises a reflective bowl 221 detachably coupling with the light body 12 within the light cavity 121, and an illuminator 222 supported within the reflective bowl 221 for generating the light towards the light opening 122. Accordingly, the manufacturer can manufacture different types of spot light by using the same universal body 10. For example, the manufacturer may use the conventional light bulb as the illuminator 222. Likewise, the manufacturer can replace a high intensity LED as the illuminator 222 to form a high intensity spot light for providing better illumination.

The universal body 10 further comprises a partition wall 13 supported at a position between the main body 11 and the light body 12 to separate the receiving compartment 111 from the light cavity 121. Therefore, the partition wall 13 is divided the spot light into two parts. One is within the main body 10 for providing stationary parts such as the power source and the circuit. One is within the light body 12 for providing replaceable illumination unit 22 to fulfill the customers' need. Accordingly, the electrical unit 21 is sealed and enclosed within the receiving compartment 111 by the partition wall 13, the electric unit 21 is protected and remained in usage when the illumination unit 22 is replaced.

The electrical unit 21 comprises a DC power supply 211 and a light circuitry 212 electrically coupling with the illumination unit 22, wherein the power supply 211 can be a battery compartment for replaceably receiving one or more batteries therein or a rechargeable battery.

It is worth mentioning that the sealing receiving compartment 111 reduces the chance of shortcuts and errors makes the spot light more stable and safe. Most important of all, a replaceable accessory element on the illumination unit 22, handle member 31, and the front and rear leg frame 33, 34 makes the spot light much more flexible to meet the customer needs. The conventional spot light usually only have one good feature, and can't fulfill the customers' need and is not suitable for different situation. The structure of the spot light is simple but flexible therefore making the apparatus easy to assemble and disassemble.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A spot light, comprising:

a universal body comprising a main body having a bottom side and a receiving compartment, a light body having a light cavity and a light opening frontwardly and integrally extending from said main body, wherein said universal body further has two spaced apart pivot slots;

a light arrangement supported by said universal body for generating light toward said light opening;

a spot light accessory which comprises a plurality of accessory elements selectively and detachably coupled with said universal body so as to provide varieties of functional utilizations of said universal body, wherein said accessory elements comprises:

a U-shaped handle member coupled at a top side of said main body such that said universal body with said handle member form a handheld spot light for allowing a user to carry said spot light;

a front leg frame; and a rear leg frame, wherein said front leg frame and said rear leg frame are pivotally coupled at front and rear portions of said main body at the bottom side thereof respectively, such that said universal body with said front and rear leg frames form a floor stand spot light, wherein said two spaced apart pivot slots are integrally and longitudinally pre-formed at said bottom side of said main body to pivotally couple with said front and rear leg frames respectively, wherein said front leg frame has a receiving cavity having a size larger than a size of said rear leg frame, wherein said front and rear leg frames are arranged to pivotally fold in such a manner that when said rear leg frame is pivotally and frontwardly folded on said bottom side of said main body, said front leg frame is pivotally and rearwardly folded to enclose said rear leg frame within said receiving cavity.

2. The spot light, as recited in claim 1, wherein said light arrangement comprises an electrical unit supported within said receiving compartment of said main body and an illumination unit replaceably supported at said light cavity of said light body to electrically couple with said electrical unit.

3. The spot light, as recited in claim 2, wherein said illumination unit comprises a reflective bowl detachably coupled with said light body within said light cavity, and an illuminator supported within said reflective bowl for generating said light toward said light opening.

4. The spot light, as recited in claim 3, wherein said universal body further comprises a partition wall supported at a position between said main body and said light body to separate said receiving compartment from said light cavity.

5. The spot light, as recited in claim 4, wherein said electrical unit comprises a DC power supply and a light circuitry electrically coupled with said illumination unit.

6. The spot light, as recited in claim 5, wherein said electrical unit contains a battery compartment for replaceably receiving one or more batteries therein, and comprises a light circuitry electrically coupled with said illumination unit.

7. The spot light, as recited in claim 3, wherein said electrical unit comprises a DC power supply and a light circuitry electrically coupled with said illumination unit.

8. The spot light, as recited in claim 7, wherein said electrical unit contains a battery compartment for replaceably receiving one or more batteries therein, and comprises a light circuitry electrically coupled with said illumination unit.

9. The spot light, as recited in claim 2, wherein said universal body further comprises a partition wall supported at a position between said main body and said light body to separate said receiving compartment from said light cavity.

10. The spot light, as recited in claim 2, wherein said electrical unit comprises a DC power supply and a light circuitry electrically coupled with said illumination unit.

11. The spot light, as recited in claim 10, wherein said electrical unit contains a battery compartment for replaceably receiving one or more batteries therein, and comprises a light circuitry electrically coupled with said illumination unit.

12. The spot light, as recited in claim 1, wherein said illumination unit comprises a reflective bowl detachably coupled with said light body within said light cavity, and an illuminator supported within said reflective bowl for generating said light toward said light opening.

13. The spot light, as recited in claim 12, wherein said universal body further comprises a partition wall supported at a position between said main body and said light body to separate said receiving compartment from said light cavity.

* * * * *